US005743764A

United States Patent [19]

Czeschka et al.

[11] Patent Number: 5,743,764

[45] Date of Patent: Apr. 28, 1998

[54] MULTIWAY CONNECTOR

[75] Inventors: Franz Czeschka, Rechberghausen; Jürgen Lapphöhn, Heiningen; Wolgang Hornig, Eckental, all of Germany

[73] Assignees: Erni Elektroapparate GmbH, Adelberg; Diehl GmbH & Co., Nuenberg, both of Germany

[21] Appl. No.: 577,274

[22] Filed: Dec. 22, 1995

[30] Foreign Application Priority Data

Dec. 24, 1994 [DE] Germany ..... 44 46 747.8

[51] Int. Cl.[6] ..... H01R 13/648

[52] U.S. Cl. ..... 439/607; 439/931

[58] Field of Search ..... 439/607, 609, 439/610, 931, 936, 945, 946

[56] References Cited

U.S. PATENT DOCUMENTS 4,780,791 10/1988 Morita et al. ..... 439/946 X 5,009,616 4/1991 Fogg et al. ..... 439/936 X 5,430,618 7/1995 Huang ..... 439/946 X 5,490,043 2/1996 Tan et al. ..... 439/946 X 5,547,397 8/1996 Hirai ..... 439/607

5,564,948 10/1996 Harting et al. ..... 439/931 X

*Primary Examiner*—Khiem Nguyen

*Attorney, Agent, or Firm*—Friedrich Kueffner

[57] ABSTRACT

A multiway connector of a non-metal material for a tight connection to metal components includes a row of metal passages, each passage having a sleeve on one side of the connector and a contact pin on another side of the connector, wherein the multiway connector is metallized with a metal coating at surfaces which come into contact with the metal components of a housing of the metal components, and wherein the side of the connector having the contact pins is covered with a sealing compound.

8 Claims, 3 Drawing Sheets

MULTIWAY CONNECTOR

BACKGROUND OF THE INVENTION

1. Field of the Invention

The present invention relates to a multiway or multipoint connector of a non-metal material for a tight connection to metal components with a housing, wherein the connector is provided with a row of metal passages which have a sleeve on one side and a contact pin on the other side.

2. Description of the Related Art

A multiway or multipoint connector of the above-described type is primarily used in a plug-type connection mounted on the face of a storage card with a metal housing for the connection to a multiway connector, for example, of a computer or the like.

Because of the way they were constructed, storage cards which have been known in the past had the significant disadvantage that they were insufficiently protected against external influences, such as dust, vapors, moisture or the like, and that, consequently, they gradually lost their operating capability after longer use.

While this has in the meantime led to the development of tight metal housings, the connection of such a housing to a suitable multiway connector still remains a weak point.

SUMMARY OF THE INVENTION

Therefore, it is the primary object of the present invention to provide an improved connector of the above-described type which eliminates the disadvantages described above and provides a tight connection.

In accordance with the present invention, the multiway connector is metallized with a metal coating at the surfaces which come into contact with the metal components of the housing and the surface with the contact pins is covered with a sealing compound.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
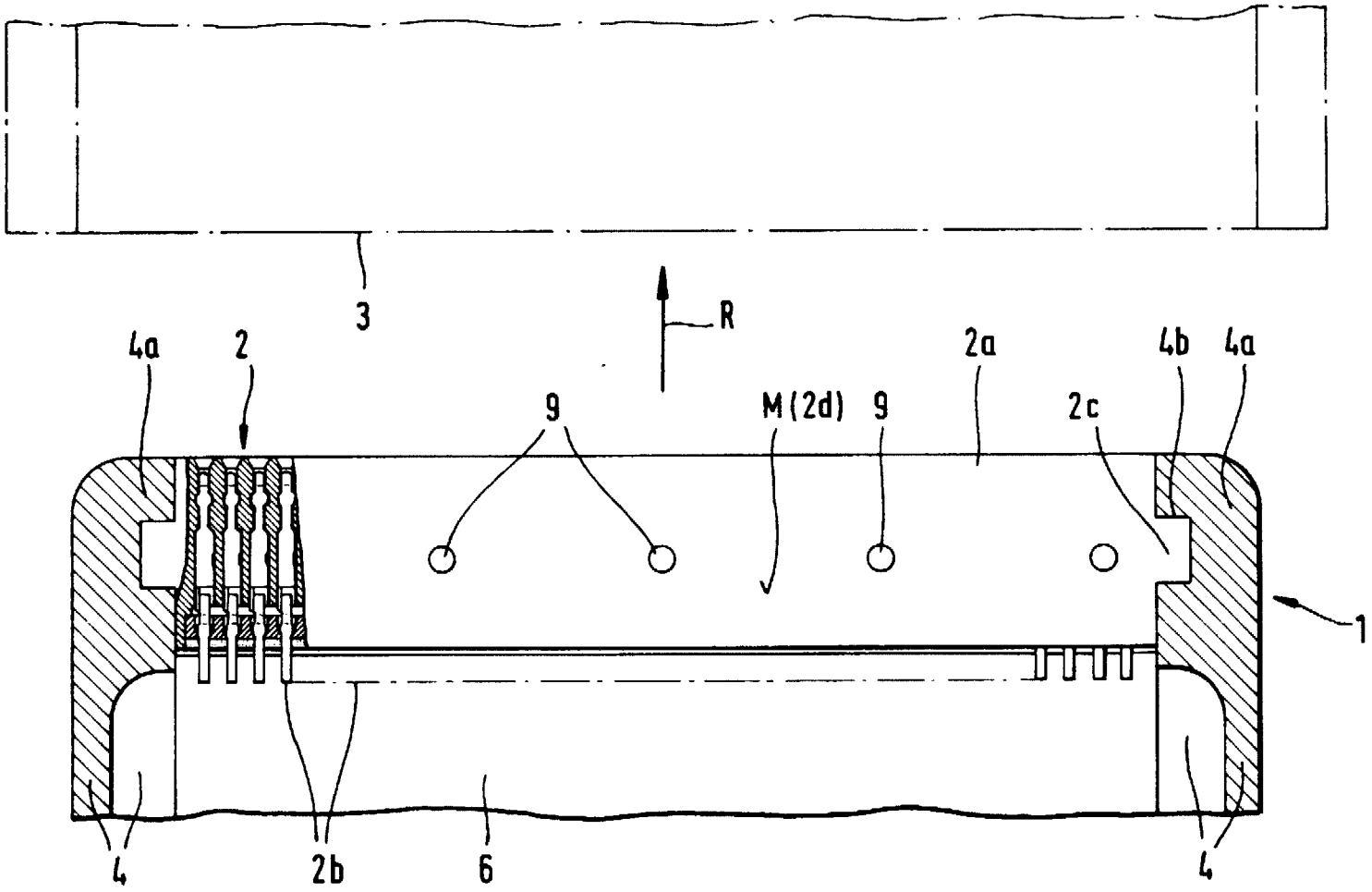
FIG. 1 is a sectional view of the end face portion of the connector according to the present invention.
Figure 2:
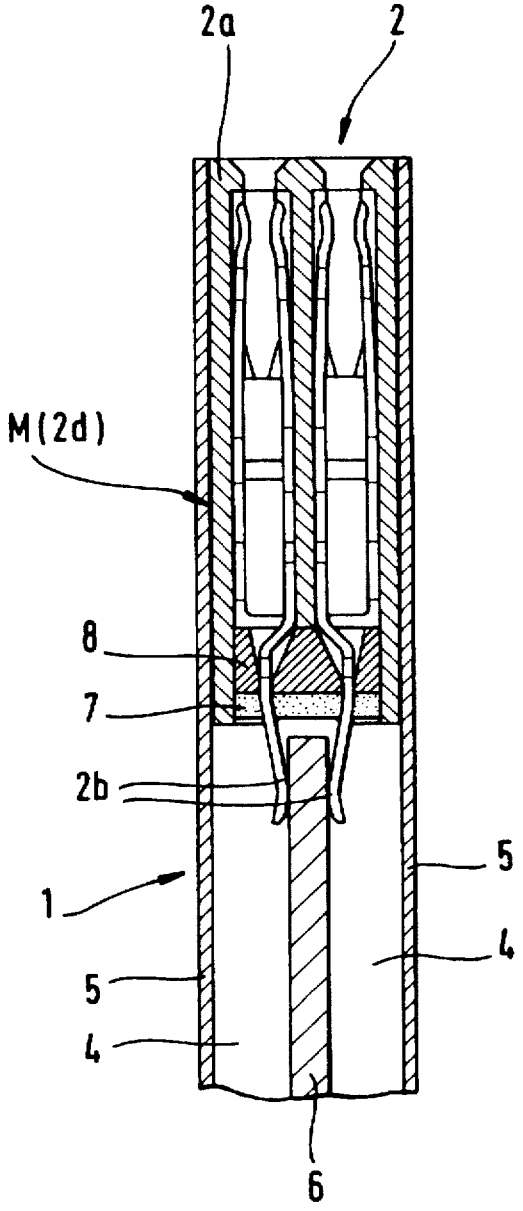
FIG. 2 is a transverse sectional view of the connector of FIG. 1, on a larger scale.
Figure 3:
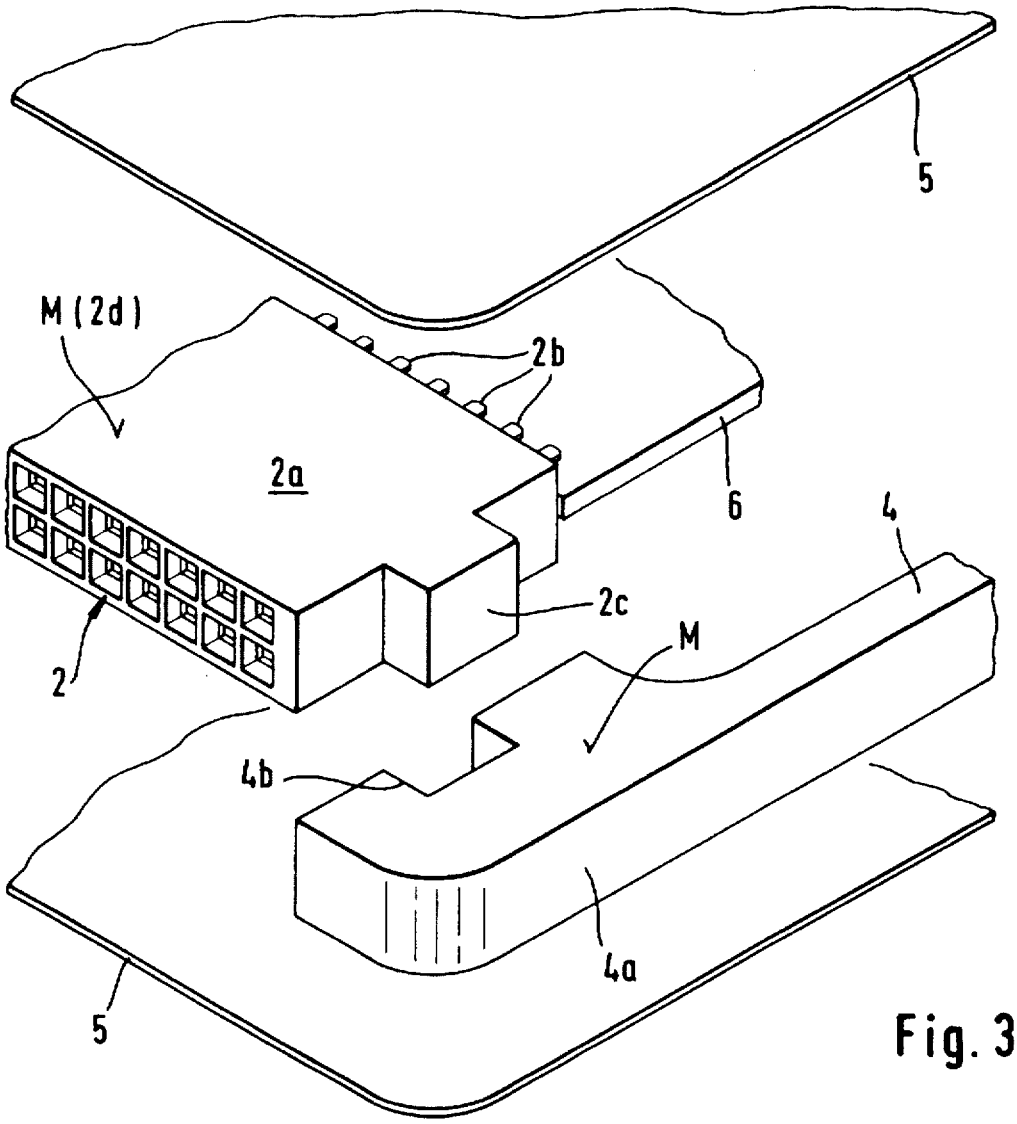
FIG. 3 is a perspective exploded view of a portion of the connector of FIG. 1.
Figure 4:
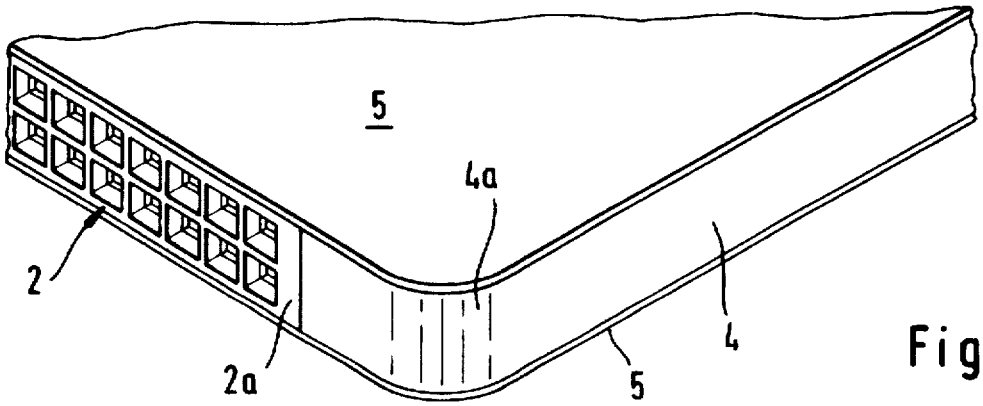
FIG. 4 is a perspective view of the portion of the connector of FIG. 3, shown in the assembled state.

The figures of the drawing generally show the connection area of a storage card 1 with a multiway connector 2*a* at the front end face for the connection to a multipoint connector 3, for example, of a computer or the like, wherein the storage card 1 has a spacer frame 4 extending in a U-shape from the multiway connector 2*a*. The frame 4 has at least metallized surfaces. The storage card 1 additionally has metal components 5 forming metal housing cover plates connected on both sides in the manner of a sandwich to the metal surfaces in a dust-tight and moisture-tight manner by soft soldering.

The multiway connector 2*a* is composed of a non-metal material and has a row of metal passsages, wherein each passage is provided on one side with a sleeve 2 and, on the other side, with a contact pin 2*b*.

In accordance with the present invention, for providing the desired tight connection, the multiway connector 2*a* is metallized at its surfaces coming into contact with the metal components 5 of the housing with a metal coating M and the surface with the contact pins 2*b* is covered with a sealing compound 7.

In accordance with another special development of the present invention, the metal coating M has a thermal expansion coefficient which is between the thermal expansion coefficients of the material of the multiway connector 2*a* and the metal components 5 of the housing, wherein, in addition, the thermal expansion coefficients of the materials of the multiway connector 2*a*, the metal components 5 of the housing and the metal coating M are adapted to each other, i.e., the coefficients are as closely together as possible.

Possible materials of the metal coating are molybdenum, tungsten, nickel/cobalt, tin, or other suitable elements. The sealing compound 7 is preferably a synthetic resin.

The connector according to the present invention additionally has lateral centering means, i.e., tongues 2*c* in the multiway connector 2*a* and grooves 4*b* in the free legs 4*a* of the frame 4, as well as pins or cams 9 on the metal-coated surfaces M of the insulating member 2*a* and corresponding recesses in the metal housing components 5 for absorbing any expansion forces.

The construction according to the present invention together with the sealing compound 7 in the contact areas underneath the cover strip 8 results in an absolutely dust-tight and moisture-tight and permanent encapsulation of the circuit plates 6 of the storage card 1.

Independently of the field of use described above, the metal coating of the connector 2*a* additionally provides the possibility of constructing the connector without sealing compound 7 at the surface with the contact pins 2*b* underneath the cover strip 8. This embodiment is used in fields in which the requirements with respect to tightness are not as high.

Finally, it is of importance that the housing components 5 are soldered to the multiway connector 2*a* in the area of the metal coating not only in soldering points or the like, but over large surface areas thereof.

The invention is not limited by the embodiments described above which are presented as examples only but can be modified in various ways within the scope of protection defined by the appended patent claims.

We claim:

1. A multiway connector of a non-metal material for a tight connection to metal components having a housing, the connector comprising a row of metal passages, each passage having a sleeve on one side of the connector and a contact pin on another side of the connector, wherein the multiway connector is metallized with a metal coating at surfaces which come into contact with the metal components of the housing, and wherein the side of the connector having the contact pins is covered with a sealing compound, wherein the surfaces with the metal coating have cams and the metal components of the housing have recesses, wherein the cams engage in the recesses for absorbing expansion forces.

2. The multiway connector according to claim 1, wherein the metal coating, the non-metal material of the connector and the metal components of the housing each have a thermal expansion coefficient, and wherein the thermal expansion coefficient of the metal coating is between the thermal expansion coefficients of the non-metal material of the connector and the metal components of the housing.

3. The multiway connector according to claim 1, wherein the metal coating, the non-metal material of the connector and the metal components of the housing each have a thermal expansion coefficient, and wherein the thermal expansion coefficients are essentially equal.

4. The multiway connector according to claim 2, wherein the material of the metal coating is selected from the group consisting of molybdenum, tungsten, nickel/cobalt and tin.

5. The multiway connector according to claim 1, wherein the sealing compound is a synthetic resin.

6. The multiway connector according to claim 1, further comprising a spacer frame receiving the connector, the spacer frame having free legs, lateral centering means being provided in the connector and the free legs of the spacer frame.

7. The multiway connector according to claim 6, wherein the lateral centering means are tongues and grooves, wherein the tongues are received in the grooves.

8. The multiway connector according to claim 1, comprising a soldered connection between the metal coating of the connector and the metal components of the housing, wherein the soldered connection extends over a large surface area of the metal coating.

* * * * *